US007296301B1

(12) United States Patent
Conn

(10) Patent No.: US 7,296,301 B1
(45) Date of Patent: Nov. 20, 2007

(54) DISPOSABLE DETACHABLE ADHESIVE KNEE-PAD

(76) Inventor: James Conn, 41 Van Duyne Ave., Rockaway, NJ (US) 07866

( * ) Notice: Subject to any disclaimer, the term of this patent is extended or adjusted under 35 U.S.C. 154(b) by 0 days.

(21) Appl. No.: 11/784,609

(22) Filed: Apr. 10, 2007

(51) Int. Cl.
*A41D 13/06* (2006.01)

(52) U.S. Cl. ..... 2/24; 2/23; 2/267

(58) Field of Classification Search ..... 2/23, 2/24, 267, 22, 268, 16, 20, 53, 56, 62, 455, 2/911; 450/55–57; 604/385.03, 385.05; 128/888, 892, 894
See application file for complete search history.

(56) References Cited

U.S. PATENT DOCUMENTS

| | | | | |
|---|---|---|---|---|
| 2,568,083 | A | 9/1951 | Mitchell | |
| 3,346,877 | A | 10/1967 | Zirves | |
| 4,561,123 | A | 12/1985 | Hull | |
| 4,561,124 | A | 12/1985 | Thompson | |
| 5,326,305 | A * | 7/1994 | Fochler | 450/57 |
| 5,507,681 | A * | 4/1996 | Smith et al. | 450/86 |
| 5,732,412 | A * | 3/1998 | Holden | 2/23 |
| 5,896,580 | A * | 4/1999 | Aldrich et al. | 2/24 |
| 5,920,902 | A | 7/1999 | Crampton | |
| 6,347,413 | B1 * | 2/2002 | Sciscente et al. | 2/465 |
| 6,425,135 | B1 * | 7/2002 | Aldrich | 2/23 |
| 7,086,926 | B2 * | 8/2006 | Falla | 450/93 |
| 2003/0000003 | A1 * | 1/2003 | Boersema | 2/69 |
| 2004/0117895 | A1 * | 6/2004 | Fortner | 2/267 |
| 2004/0143887 | A1 * | 7/2004 | Durkin et al. | 2/267 |
| 2005/0005345 | A1 * | 1/2005 | Chen | 2/267 |
| 2005/0268370 | A1 * | 12/2005 | Frieler et al. | 2/24 |
| 2006/0010576 | A1 * | 1/2006 | Tse et al. | 2/244 |

* cited by examiner

*Primary Examiner*—Amy B. Vanatta
(74) *Attorney, Agent, or Firm*—Thomas J. Germinario

(57) ABSTRACT

A disposable, adhesively attachable knee-pad comprises a durable, impermeable outer casing, within which is contained a resilient padding layer, which is in turn bonded to a temporary adhesive layer. The knee-pad is attached to a pants leg by means of the temporary adhesive layer and is readily detachable without causing damage to or leaving residue on the pants fabric.

6 Claims, 4 Drawing Sheets

DISPOSABLE DETACHABLE ADHESIVE KNEE-PAD

BACKGROUND OF THE INVENTION

Many occupations and avocations require that persons spend extended periods of time in a kneeling position, with either one on both knees in contact with the floor or ground. Craftsmen and laborers engaged in installing and/or refinishing floors are often on their knees for hours at a time. Plumbers, carpenters, electricians and automobile mechanics often engage in activities that call for protracted kneeling. Farmers, landscapers and gardeners must also perform many of their activities in a kneeling or semi-kneeling posture.

Such kneeling activities expose participants to great discomfort and risk of knee injuries, as that sensitive joint is in extended contact with hard surfaces and jagged objects. The kneeling posture also places considerable pressure on the knee joint, which must bear the weight of the body. Since kneeling activities often involve some movement on the knees from place to place, the worker's knees are also exposed to abrasive forces that can cause irritation and injury. Another adverse effect is excessive wear and eventual damage to the worker's pants, particularly in the knee area.

These problems are compounded when the surface on which the knees rest is moist or impregnated with chemical agents. During the finishing of floors, for example, the worker must often kneel in areas on which varnishes or stains have recently been applied. Likewise, plumbers and automobile mechanics frequently must kneel in work areas exposed to oils and/or solvents. Similarly, a farmer, landscaper or gardener will frequently kneel on damp ground or soil that has recently been fertilized or sprayed with insecticides and/or herbicides. Such fluids will not only stain the worker's pants, but they will also penetrate to the skin of the knees and legs of the workers, thereby causing toxic reactions, such as rashes. More serious health impacts will result from prolonged and repeated skin exposures to such chemical agents. Dampness itself, even without chemical contaminants, will also cause and/or aggravate rheumatic symptoms in the joint, especially when combined with the stress of the kneeling posture.

Therefore, it is desirable to have a means of: (i) cushioning the knee of the worker, so as to reduce the stress and discomfort of the kneeling posture, (ii) protecting and insulating the knee from exposure to moisture and/or fluids on the surfaces with which it comes in contact, and (iii) preventing damage to the worker's pants from both abrasive forces and absorbed fluids.

The prior art has addressed this need with a variety of knee-pads which can be attached to the knee area of the pants or directly to the worker's leg. One type of knee-pad, as disclosed in Hull, U.S. Pat. No. 4,561,123, uses two straps that are secured around the leg, respectively, above and below the knee, with a cushioning pad attached between the two straps. The problem with strap-secured knee-pads, however, is that the straps will not hold the pad in a fixed position unless they are tight enough to cause discomfort and/or restrict blood circulation in the leg. The movement of the leg and the flexing of the knee joint will cause straps to loosen, requiring the worker to continually interrupt his/her activities in order to tighten or adjust the straps.

An alternate design disclosed in the Hull patent dispenses with need for straps, but requires that Velcro strips be attached to the worker's pants above and below the knee so that these strips can be attached to corresponding Velcro strips on the knee-pad. This design has several disadvantages. It requires the worker's pants to be modified to incorporate the Velcro strips in the knee area. This is inconvenient and renders the pants unsuitable and unattractive for ordinary wear. Also, if the worker does not anticipate the need for knee-pads in his/her work, or forgets to wear the appropriate pair of pants, this type of knee-pad becomes useless.

Another strapless knee-pad design, as disclosed in Mitchell, U.S. Pat. No. 2,568,083, attempts to avoid the unsightliness of the fastening means incorporated in the pants leg by concealing them under flaps overlapping the seams of the garment. This configuration is even more impractical and inconvenient than that of the Hull patent, since now the worker must buy a specially-manufactured pair of pants incorporating the hidden seam flaps rather than merely sewing Velcro strips onto an ordinary pair of pants.

A knee-pad that seeks to avoid the foregoing problems of the strap-on and modified-pants configurations is disclosed in Zirves, U.S. Pat. No. 3,346,877. Instead of long straps that surround the leg, this design uses short straps terminating in alligator-type clips that can be attached to the seams on either side of the pants. Here, however, the fastening clips are apt to become dislodged when the sides of the worker's leg press against the floor or ground, and there will be repeated re-fastening and adjustment required.

Yet another approach to knee-pads for work pants is disclosed in Crampton, U.S. Pat. No. 5,920,902, and Thompson, U.S. Pat. No. 4,561,124. In both cases, the padding is installed on the inside of the pants legs to avoid the unsightliness of external padding. In both cases, the pants are permanently modified. In the Crampton patent, the knee pads are permanently affixed to the inside of the pants legs with a strong adhesive, while in the Thompson patent pockets are sewn within the pants legs to hold the padding. These inventions share the disadvantage of the other modified-pants designs, since they require the worker to wear a special garment in order to enjoy the benefit of the knee-pads. Furthermore, due to their installation within the pants legs, the Crampton and Thompson disclosures afford no protection for the outer knee area of the garment from abrasive forces encountered while in contact with rugged floor or ground surfaces.

While the prior art concentrates on the objective of cushioning the knee, it ignores the need to protect the knee with a moisture-proof barrier. While the outer layer of such knee-pads is often specified to be made of a durable material, the need for a fluid-impregnable outer layer is not addressed. This deficiency in the prior art is compounded by the fact that the knee-pads disclosed therein are all intended to be reusable, since the complexity and expense of their fabrication renders them unsuitable for one-time, disposable use. Such non-impervious reusable knee-pads will require periodic cleaning when they become damp and soiled by contact with the ground or flooring materials. In order not to compromise their fastening components, such knee-pads must be hand-laundered, thereby further adding to the expense and inconvenience of their use.

Consequently, the prior art leaves an unaddressed need for an impervious, disposable knee-pad that can be used with any ordinary, unmodified pair of pants and requires neither straps nor fastening clips/hooks to hold it in place.

SUMMARY OF THE INVENTION

An object of this invention is to provide a knee-pad that effectively cushions the knee during extended periods of kneeling on hard and/or rugged surfaces.

Another object of this invention is to provide a knee-pad that surrounds the knee on all sides with a durable material that is impervious to liquids, so that the knee and the pant leg covering it remain dry when kneeling on moist surfaces.

Another object of this invention is to provide a knee-pad that will protect the pants from damage due to abrasive contact with rugged floor and/or ground surfaces.

Another object of this invention is to provide a knee-pad that can be secured to the knee area of the pants leg without the use of straps, hooks or other mechanical fasteners incorporated in the knee pad itself.

Another object of this invention is to provide a knee-pad that can be attached to any ordinary pair of pants without modifying the pants in any way and without affixing any separate fastening means to the pants.

Another object of this invention is to provide a knee-pad that is self-adhering to a cloth garment and readily detachable without damaging the fiber or pigment of the cloth and without leaving an adhesive residue on the garment.

Another object of this invention is to provide a knee-pad having simple, inexpensive components and capable of being manufactured in high volume at a low per-unit cost.

Another object of this invention is to provide a knee-pad that is disposed of after a single use and replaced with other identical pads for subsequent uses.

These and other worthwhile objects are achieved by a knee-pad comprising a durable, flexible, impermeable outer casing, within which is contained a flexible, resilient padding layer. At the back of the knee-pad is an adhesive layer that removably attaches to the knee area of the work pants.

DETAILED DESCRIPTION OF THE INVENTION

Figure 1:
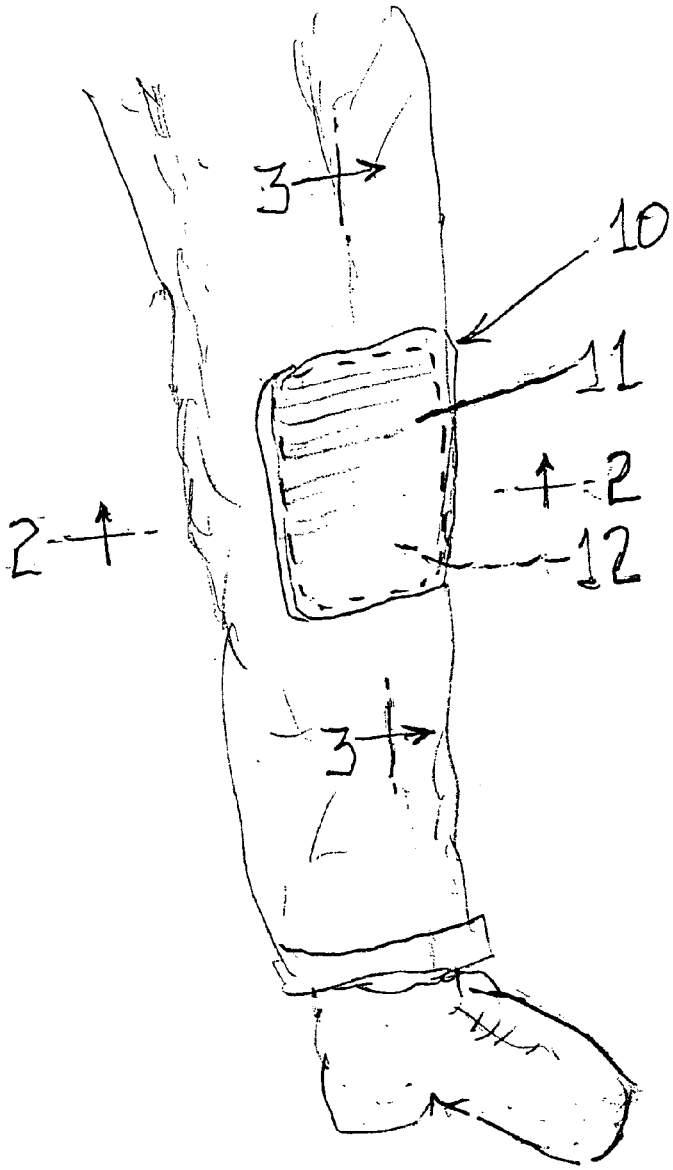
FIG. 1 is a perspective view of a pants leg with a knee-pad embodiment of this invention attached thereto.
Figure 4:
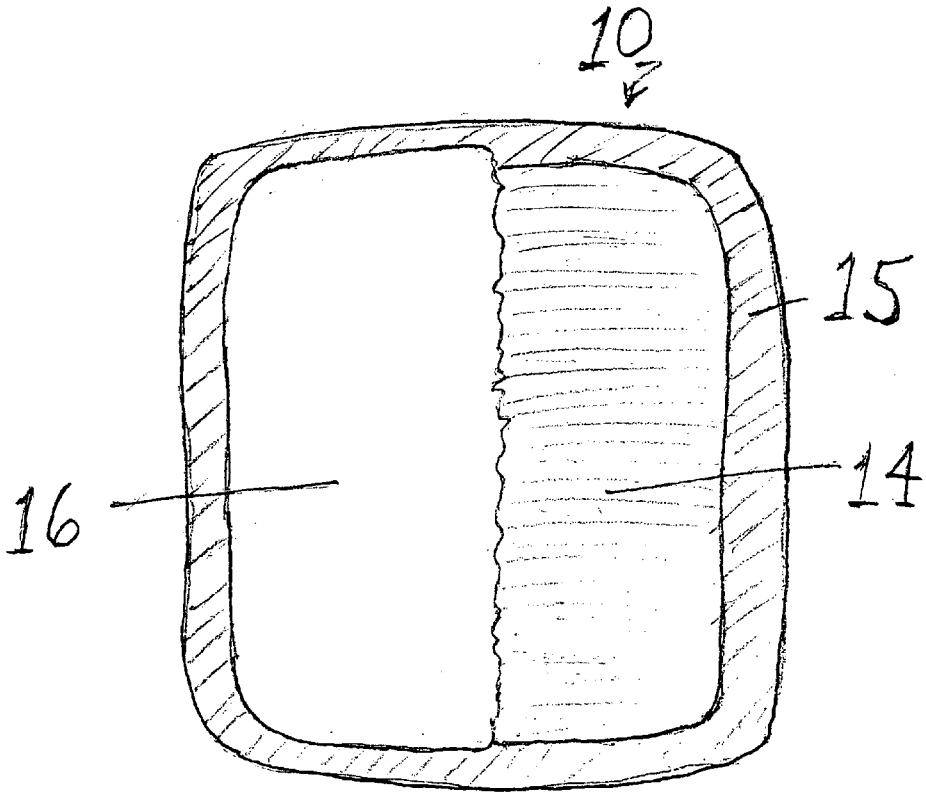
FIG. 4 is a partially cut-away plan view of the back side of the knee-pad.

A disposable, detachable adhesive knee-pad having the features of the present invention 10 is depicted in FIGS. 1 though 4. The knee-pad has a front side that faces outward when the knee-pad is attached to a pants leg, as depicted in FIG. 1, and a back side, as depicted in FIG. 4, where the knee-pad attaches to the pants leg.

Figure 2:
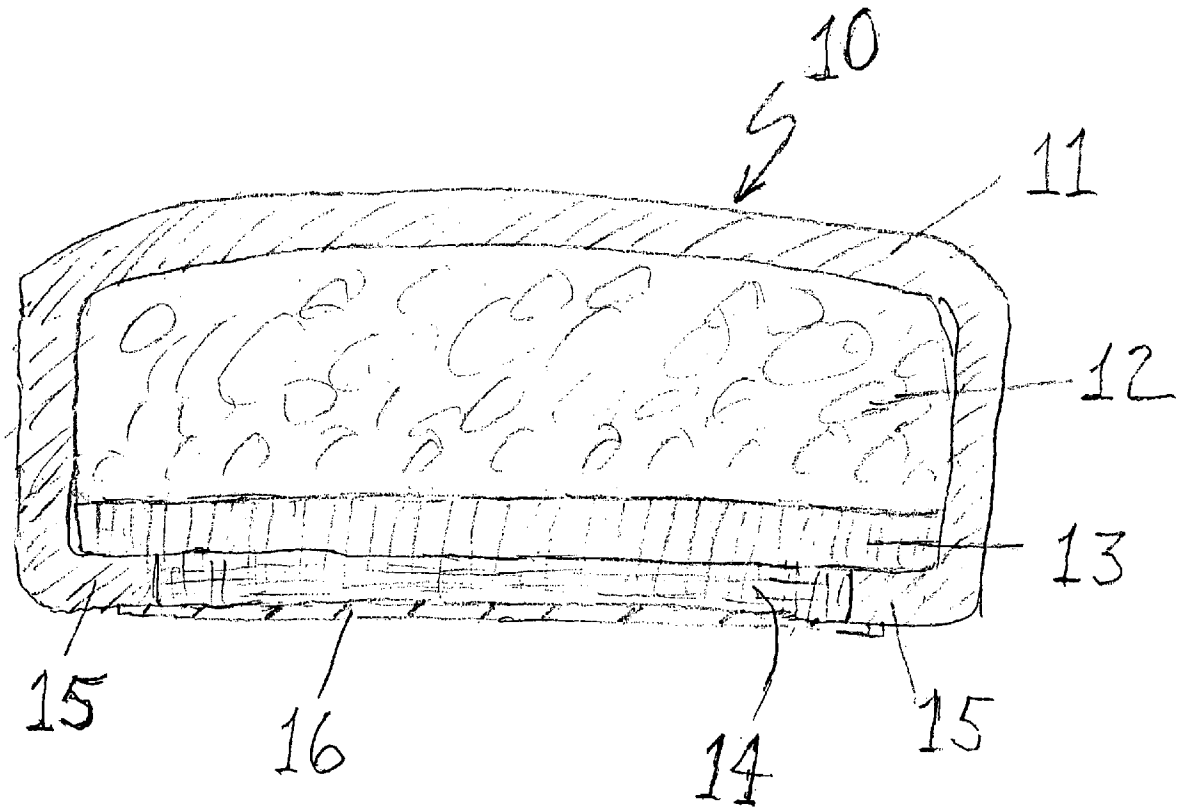
FIG. 2 is a cross-section view of the knee-pad along the line 2-2 of FIG. 1.
Figure 3:
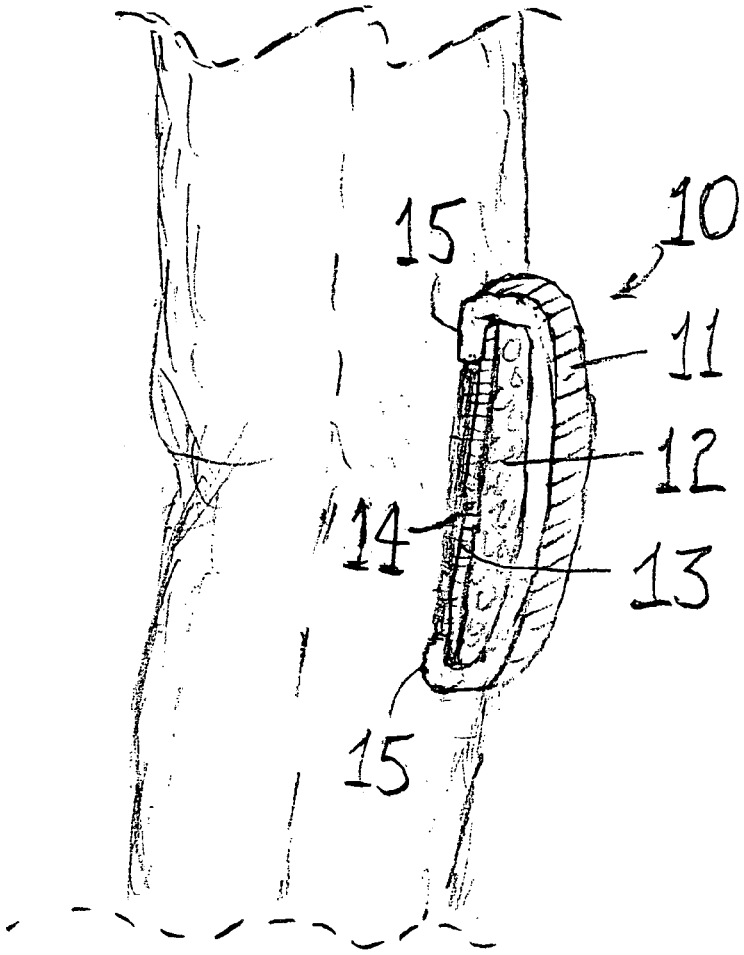
FIG. 3 is a perspective view of a pants leg with the knee-pad attached, showing a cross-section of the knee-pad along the line 3-3 of FIG. 1.

Referring to FIGS. 2 and 3, the knee-pad comprises an outer casing 11, which forms a concave cavity containing a padding layer 12. The padding layer 12 is bonded by a permanent adhesive layer 13 to a temporary adhesive layer 14, as well as to the peripheral edges 15 of the outer casing 11. A peel sheet 16 is releasably secured to the back side of the knee-pad to cover the outer surface of the temporary adhesive layer 14, as depicted in FIG. 4.

The outer casing 11 of the knee-pad comprises an oblong piece of a durable, flexible, impermeable, chemical-resistant plastic, such as polyethylene or polypropylene, having a thickness of 3 to 10 mils (0.003 to 0.01 inch), depending on the application. The padding layer 12 consists of a flexible, resilient natural or synthetic padding material. The preferred material is polyurethane foam. Recycled carpet padding is one low-cost option. The padding layer 12 is a quarter-inch (¼") to one inch (1") in thickness, depending on the application.

The permanent adhesive layer 13 consists of a strong waterproof adhesive, preferably latex-based. The thickness of the permanent adhesive layer 13 is optimally 10 to 15 mils (0.01 to 0.015 inch), sufficient to form a permanent, durable bond between the peripheral edges 15 of the outer casing 11, the padding layer 12, and the temporary adhesive layer 14. Preferably, the bond between the aforesaid components is formed by a hot-melt adhesive application.

The temporary adhesive layer 14 comprises a non-permanent, detachable, pressure sensitive adhesive that will not damage a typical work pants fabric (such as cotton or polyester) or leave residue on the fabric upon being removed. Preferably, the temporary adhesive layer 14 consists of a 5 mil to 10 mil (0.005" to 0.01") layer of high-tack acrylic adhesive.

The peel sheet 16 is placed over the temporary adhesive layer 14 to protect it prior to the knee-pad being attached to the work pants. The peel sheet 16 consists of a thin, peelable film, which can be a plastic film or a film/paper laminate, approximately 1 mil (0.001") in thickness.

In the preferred embodiment, the overall dimensions of the knee-pad 10 are eight to ten inches (8" to 10") in length and five to six inches (5" to 6") in width.

A disposable, detachable, adhesive knee-pad with the features of the present invention is supplied in sets consisting of three or more pairs of knee pads. Each knee-pad is readied for use by peeling off the peel sheet and then pressing the exposed temporary adhesive layer against the knee area of the workpants until the knee-pad adheres to the pants. After the kneeling tasks are completed, the knee-pads are detached from the pants legs and disposed of. When the next occasion of kneeling tasks arises, another pair of knee-pads are readied for use and applied in the same manner as set forth above.

While the foregoing specification has described a preferred embodiment of the present invention, one skilled in the art may make many modifications to the preferred embodiment without departing form the invention in its broader aspects. The appended claims therefore are intended to cover all such modifications as fall within the scope and spirit of the invention.

What is claimed is:

1. A disposable knee-pad comprising:

(a) an outer casing consisting of an oblong sheet of durable, flexible, impermeable, chemical-resistant plastic, which outer casing has peripheral edges which are folded inward toward the center of the oblong sheet to form a concave cavity within the outer casing;

(b) a padding layer located inside the concave cavity of the outer casing, which padding layer consists of a flexible, resilient natural or synthetic padding material;

(c) a permanent adhesive layer located between the padding layer and the peripheral edges of the outer casing, which permanent adhesive layer is permanently adhesively bonded to the padding layer, the peripheral, edges of the outer casing, and a temporary adhesive layer, which temporary adhesive layer constitutes the area of the knee pad which detachably adheres to a pants leg, and which temporary adhesive layer consists of a non-permanent, pressure sensitive adhesive that will not damage a typical work pants fabric or leave adhesive residue thereupon when the knee-pad is detached from the pants leg; and (d) a peel sheet which overlays and protects the temporary adhesive layer before the knee-pad is readied for attachment to a pants leg, and which peel sheet is removed, thereby exposing the temporary adhesive layer, prior to attaching the knee-pad to a pants leg.

2. The disposable knee pad according to claim 1, wherein the outer casing is fabricated of polyethylene or polypropylene having a thickness of 3 to 10 mils.

3. The disposable knee pad according to claim 2, wherein the padding layer consists of polyurethane foam having a thickness of ¼ to 1 inch.

4. The disposable knee pad according to claim 3, wherein the permanent adhesive layer consists of latex-based adhesive having a thickness of 10 to 15 mils.

5. The disposable knee pad according to claim 4, wherein the temporary adhesive layer consists of high-tack acrylic adhesive having a thickness of 5 to 10 mils.

6. The disposable knee pad according to claim 5, wherein the peel sheet consists of a peelable plastic film or film/paper laminate having a thickness of approximately 1 mil.

* * * * *